US010147575B2

(12) United States Patent
Suzuki

(10) Patent No.: US 10,147,575 B2
(45) Date of Patent: Dec. 4, 2018

(54) ELECTROMAGNETIC SWITCH FOR STARTER

(71) Applicant: DENSO CORPORATION, Kariya, Aichi-pref. (JP)

(72) Inventor: Yoshiaki Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 118 days.

(21) Appl. No.: 14/948,802

(22) Filed: Nov. 23, 2015

(65) Prior Publication Data

US 2016/0155590 A1 Jun. 2, 2016

(30) Foreign Application Priority Data

Nov. 28, 2014 (JP) ..... 2014-240189

(51) Int. Cl.
*H01H 47/22* (2006.01)
*H01H 51/06* (2006.01)
*H01H 50/02* (2006.01)

(52) U.S. Cl.
CPC ..... *H01H 47/22* (2013.01); *H01H 50/021* (2013.01); *H01H 51/065* (2013.01)

(58) Field of Classification Search
CPC ..... H01H 47/22; H01H 50/021; H01H 51/065
See application file for complete search history.

(56) References Cited

U.S. PATENT DOCUMENTS 4,256,967 A * 3/1981 Treharne ..... B01J 12/002 422/186
4,259,938 A * 4/1981 Johansson ..... F02P 3/093 123/599
4,521,822 A * 6/1985 Simard ..... H02H 7/042 315/125
4,574,324 A * 3/1986 Packard ..... H02H 3/05 361/156
5,152,410 A * 10/1992 Ta ..... B61G 7/14 213/212
5,584,974 A * 12/1996 Sellers ..... H01J 37/34 204/192.12
2003/0042873 A1* 3/2003 Osada ..... F02N 11/0825 320/166
2005/0270720 A1* 12/2005 Johnson, Jr. ..... G01R 31/3278 361/170
2010/0264765 A1 10/2010 Haruno et al.
2011/0248803 A1 10/2011 Niimi et al.
(Continued)

FOREIGN PATENT DOCUMENTS

JP S50-114617 U 9/1975
JP S56-125812 A 10/1981
(Continued)

*Primary Examiner* — Zeev V Kitov
(74) *Attorney, Agent, or Firm* — Oliff PLC

(57) ABSTRACT

An electromagnetic switch for a starter includes a coil that includes a first lead wire connected to a power supply side and a second lead wire connected to a ground side, the coil being supplied with an energization current through the first and second lead wires to form an electromagnet while a starter relay is on. The electromagnetic switch further includes a surge suppression device that absorbs part of energy emitted from the coil when the starter relay is turned from on to off so that a remaining part of the energy is applied to the starter relay to cause an arc current to flow between contacts of the starter relay.

5 Claims, 7 Drawing Sheets

(56) References Cited

U.S. PATENT DOCUMENTS

| | | | | |
|---|---|---|---|---|
| 2012/0260770 | A1 | 10/2012 | Nawa et al. | |
| 2013/0070375 | A1* | 3/2013 | Schueler ..... | H01H 47/32<br>361/54 |
| 2014/0239641 | A1 | 8/2014 | Haruno et al. | |

FOREIGN PATENT DOCUMENTS

| | | | |
|---|---|---|---|
| JP | S58-174946 | U | 11/1983 |
| JP | S60-130018 | A | 7/1985 |
| JP | 2010-062078 | A | 3/2010 |
| JP | 2011-169308 | A | 9/2011 |
| JP | 2011-222410 | A | 11/2011 |

* cited by examiner

ELECTROMAGNETIC SWITCH FOR STARTER

This application claims priority to Japanese Patent Application No. 2014-241089 filed on Nov. 28, 2014, the entire contents of which are hereby incorporated by reference.

BACKGROUND OF THE INVENTION

1. Field of the Invention

The present invention relates to an electromagnetic switch mounted on a starter for starting an engine.

2. Description of Related Art

Generally, an electromagnetic switch mounted on a starter is configured to generate a counter electromotive force across a coil depending on the inductance of the coil when a starter relay is turned off to interrupt a current flowing through the coil. If the counter electromotive force is applied to the starter relay, since an arc discharge occurs between the contacts of the starter relay, the contacts are worn, causing the life of the contacts to be reduced. Particularly, for the case of automobiles provided with an idling stop function, since the required life of the contacts is exceedingly long, it is critical to suppress occurrence of such an arc discharge to ensure a certain level of the life of the contacts.

As a measure to suppress such an arc discharge, it is known to connect a diode as a surge absorption element in parallel to the coil, as described, for example, in Japanese Patent Application Laid-open No. 2011-222410. The cathode terminal of the diode is connected to one end on the power source side of the coil. The anode terminal of the diode is connected to the other end on the ground side of the coil. Accordingly, when the starter relay is turned off to interrupt a current flowing through the coil, since a current generated due to the counter electromotive force across the coil is absorbed by the diode, the counter electromotive force can be prevented from being applied to the starter relay. Hence, it is possible to suppress wear of the contacts to ensure a necessary life of the contacts.

Meanwhile, it is known to clean the surfaces of the contacts of an electromagnetic relay by generating an appropriate arc discharge between the contacts to burn off oil or dust adhered to the contacts. However, in the case of the electromagnetic switch described in the above patent document where a diode as a surge-absorbing element is parallel-connected to the coil, since the current generated due to the counter electromotive force across the coil is absorbed by the diode, and accordingly the arc discharge between the coils of the starter relay becomes very small, there is a concern that the surface of the contacts cannot be cleaned sufficiently.

SUMMARY

An exemplary embodiment provides an electromagnetic switch for a starter, including:

a coil that includes a first lead wire connected to a power supply side and a second lead wire connected to a ground side, the coil being supplied with an energization current through the first and second lead wires to form an electromagnet while a starter relay is on; and a surge suppression device that absorbs part of energy emitted from the coil when the starter relay is turned from on to off so that a remaining part of the energy is applied to the starter relay to cause an arc current to flow between contacts of the starter relay.

According to the exemplary embodiment, there is provided an electromagnetic switch for a starter, which is capable of suppressing wear of the contacts of a starter relay, and cleaning the surfaces of the contacts to increase the life of the contacts.

Other advantages and features of the invention will become apparent from the following description including the drawings and claims.

PREFERRED EMBODIMENTS OF THE INVENTION

Figure 1:
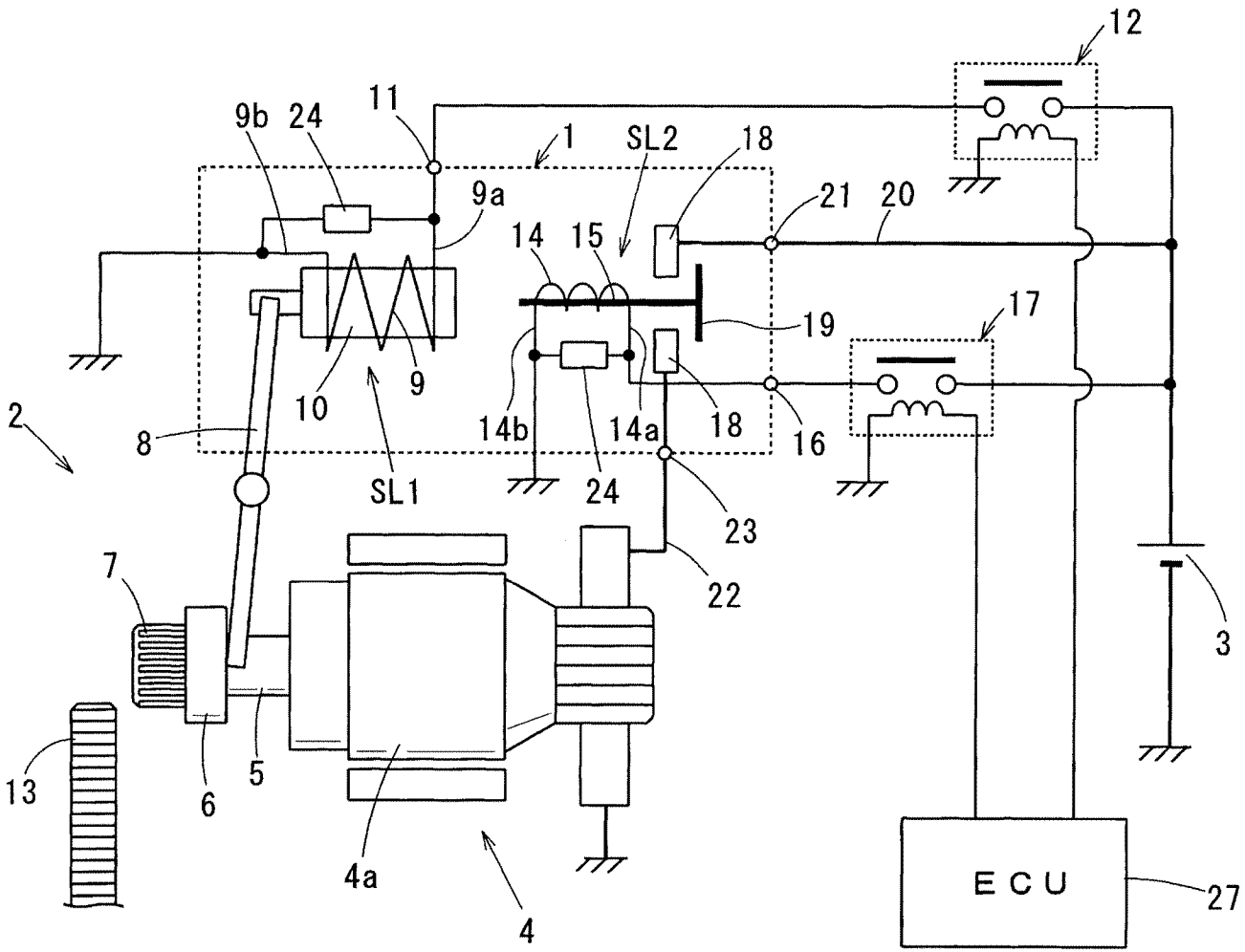
FIG. 1 is a circuit diagram of a starter including an electromagnetic switch according to an embodiment of the invention.

FIG. 1 is a circuit diagram of a starter 2 including an electromagnetic switch 1 according to an embodiment of the invention. The starter 2 is for starting an engine of an automobile having an idling stop function. The idling stop function is for automatically stopping the engine by stopping fuel injection to the engine when the automobile is stopped at an intersection, or stopped due to traffic jam, for example. As shown in FIG. 1, the starter 2 includes a motor 4 which generates a rotational force at its armature 4*a* when supplied with electric power from a battery 3, an output shaft 5 which is driven to rotate by the motor 4, a pinion 7 which is integral with a clutch 7 mounted on the output shaft 5, and the electromagnetic switch 1.

The electromagnetic switch 1 includes a solenoid SL1 for pushing out the pinion 7 and the clutch 6 to the opposite motor side (the left side in FIG. 1) through a shift lever 8, and a solenoid SL2 for opening and closing a main contact (to be explained later) provided in the current passage of the motor 4. The current passage of the motor 4 is a power supply line for supplying a current from the battery 3 to the motor 4. The current flowing to the motor 4 is turned on and off by opening and closing the main contact. The solenoid SL1 includes a SL1 coil 9 wound on a resin made bobbin and disposed on a first end side (the left side end in FIG. 1) of a frame (not shown), and a SL1 plunger 10 which is axially movable within the SL1 coil 9. The frame doubles as an outer frame of the electromagnetic switch 1 and magnetic circuits of the solenoids SL1 and SL2.

The SL1 coil 9 is connected with a lead wire 9*a* which is connected to a SL1 terminal 11, and connected with a lead wire 9*b* which is grounded through a metal component (not shown) of the solenoid SL1. The metal component forms part of the magnetic circuit of the solenoid SL1, and is in electrical contact with the frame. The SL1 terminal 11 is connected to the battery 3 through a contact-type SL1 relay 12 so that an energization current is supplied from the battery 3 when the SL1 relay 12 is on. The SL1 plunger 10 includes a joint (not shown) for transmitting the movement of the SL1 plunger 10 to the shift lever 8, and a drive spring (not shown) for storing a reaction to cause the pinion 7 to mesh with a ring gear 13 of the engine (not shown).

The solenoid SL2 includes a SL2 coil 14 wound on a resin made bobbin and disposed on a second end side (the right end side in FIG. 1) of the frame, and a SL2 plunger 15 which is axially movable within the SL2 coil 14. The SL2 coil 14 is connected with a lead wire 14*a* which is connected to a SL2 terminal 16, and connected with a lead wire 14*b* which is grounded through a metal component (not shown) of the solenoid SL2. The metal component forms part of the magnetic circuit of the solenoid SL2, and is in electrical contact with the frame. The foregoing lead wire 9*b* of the SL1 coil 9 may be connected to the metal component of the solenoid SL2. The SL2 terminal 16 is connected to the battery 3 through a contact-type SL2 relay 17 so that an energization current is supplied from the battery 3 when the SL2 relay 17 is on.

A fixed iron core (not shown) is disposed between the SL1 plunger 10 and the SL2 plunger 15 so as to be shared by the solenoids SL1 and SL2. The fixed iron core attracts the SL1 plunger 10 by being magnetized when the SL1 coil 9 is energized, and attracts the SL2 plunger 15 by being magnetized when the SL2 coil 14 is energized. Between the fixed iron core and the SL1 plunger 10, there is disposed a return spring (not shown) which pushes back the SL1 plunger 10 to the opposite fixed iron core side when supply of the energization current to the SL1 coil 9 is stopped. Between the fixed iron core and the SL2 plunger 15, there is disposed a return spring (not shown) which pushes back the SL2 plunger 15 to the opposite fixed iron core side when supply of the energization current to the SL2 coil 14 is stopped.

The main contact is constituted of a pair of fixed contacts 18 which are connected to the current passage of the motor 4 respectively through two terminal bolts, and a movable contact 19 which connects and disconnects between the fixed contacts 18 in accordance with the movement of the SL2 plunger 15. One of the two terminal bolts is a B-terminal bolt 21 connected with a battery cable 20. The other of the two terminal bolts is an M-terminal bolt 23 connected with a lead wire 22 drawn from the motor 4. They are fitted to a resin cover (not shown) of the electromagnetic switch 1. The resin cover is assembled to the frame so as to close the opening of the frame, which opens to the second end side of the frame. The resin cover is swaged and fixed to the end portion of the opening at its outer periphery.

The solenoid SL1 includes a surge suppression device 24 which absorbs part of the energy emitted from the SL1 coil 9 when the SL1 relay 12 is turned from on to off. Likewise, the solenoid SL2 includes a surge suppression unit 24 which absorbs part of the energy emitted from the SL2 coil 14 when the SL2 relay 17 is turned from on to off. One of the two surge suppression device 24 is connected in parallel to the SL1 coil 9 between the SL1 terminal 11 and the metal component. The other suppression device 24 is connected in parallel to the SL2 coil 14 between the SL2 terminal 16 and the metal component.

Figure 2:
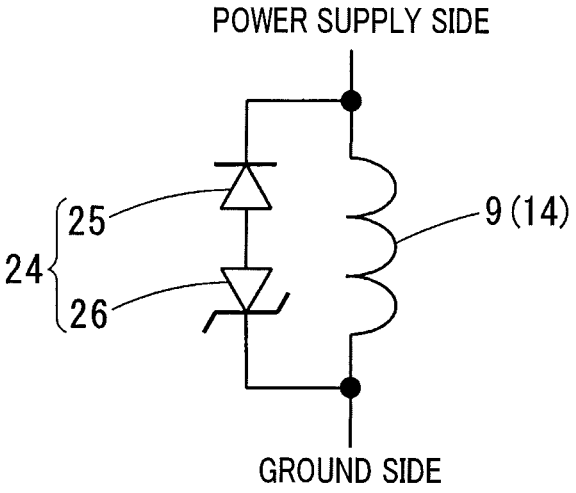
FIG. 2 is a diagram showing the structure of a surge suppression device according to a first example included in the electromagnetic switch.

Next, the structure of a first example of the surge suppression device 24 is explained with reference to FIG. 2. As shown in FIG. 2, the surge suppression unit 24 according to the first example is constituted of a diode 25 and a Zener diode 26 whose anodes are connected to each other. The cathode of the diode 25 is connected to the power supply side of the SL1 coil 9 or the SL2 coil 14. The cathode of the Zener diode 26 is connected to the ground side of the SL1 coil 9 or the SL2 coil 14.

Figure 3:
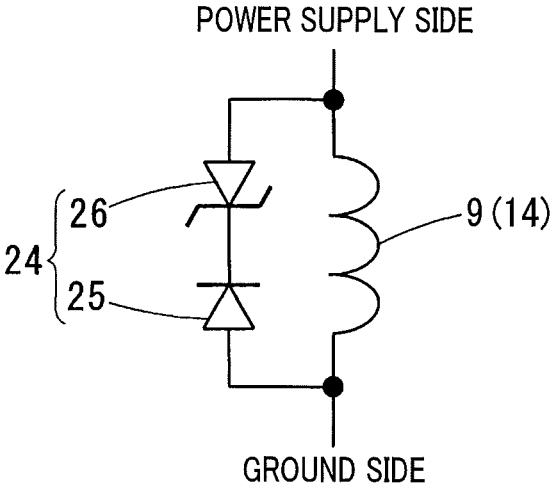
FIG. 3 is a diagram showing the structure of a modification of the surge suppression device according to the first example.

FIG. 3 shows the structure of a modification of the first example of the surge suppression unit 24. As shown in FIG. 3, in this modification, the diode 25 is disposed on the ground side, and the Zener diode 26 is disposed on the power supply side in contrast to the first example shown in FIG. 2. Specifically, in this modification, the cathodes of the diode 25 and the Zener diode 26 are connected to each other, the anode of the Zener diode 26 is connected to the power supply side of the SL1 coil 9 or the SL2 coil 14, and the anode of the diode 25 is connected to the ground side of the SL1 coil 9 or the SL2 coil 14.

Here, the power supply side of the SL1 coil 9 and the SL2 coil 14 is the positive voltage side from which a current flows to the SL1 coil 9 or the SL2 coil 14 when the SL1 relay 12 or the SL2 relay 17 is turned on, and the ground side is the negative voltage side from which the current flows out. However, it should be noted that the polarity of the counter electromotive force generated across the SL1 coil 9 or the SL2 coil 14 when the SL1 relay 12 or the SL2 relay 17 is turned off is negative on the power supply side of the SL1 coil 9 or the SL2 coil 14, and is positive on the ground side of the SL1 coil 9 or the SL2 coil 14.

Next, the operation of the starter 2 is explained. The operation of the starter 2 is controlled by an ECU 27 provided for performing the idling stop control. The ECU 27 is capable of controlling the solenoid SL1 and the solenoid SL2 independently in accordance with the engine speed when an engine restart request has occurred after an idling stop operation was performed. In the following, the operation of the starter 2 is explained for a case where the engine speed is low (below 400 rpm, for example). The ECU 27 energizes the solenoid SL1 earlier than the solenoid SL2 in response to occurrence of an engine restart request. Specifically, the ECU 27 turns on the SL1 relay 12 earlier than the SL2 relay 17.

When the SL1 relay 12 is turned on by the ECU 27, the SL1 terminal 11 is supplied with current from the battery 3, and the SL1 coil 9 connected to the SL1 terminal 11 is energized. As a result, the SL1 plunger 10 is attracted by the magnetized fixed iron core to move in the axial direction to the second end side, causing the pinion 7 to be pushed out to the opposite motor side together with the clutch 6 by the shift lever 8. When the inertially rotating ring gear 13 comes to a position at which it can mesh with the pinion 7 after the end surface of the pinion 7 abuts against the end surface of the ring gear 13, the pinion 7 is pushed out by the reaction force stored in the drive spring, and meshes with the ring gear 13.

When the SL2 relay 17 is turned on by the ECU 27, the SL2 terminal 16 is supplied with a current from the battery 3, and the SL2 coil 14 connected to the SL2 terminal 16 is energized. As a result, the SL2 plunger 15 is attracted by the magnetized fixed iron core to move in the axial direction to the first end side, causing the movable terminal 19 to abut against the pair of the fixed contacts 18 to close the main contact. As a result, the motor 4 is supplied with electric power from the battery 3, and a rotational force is generated in the armature 4*a* of the motor 4. The rotational force of the armature 4*a* is transmitted to the output shaft 5 causing the output shaft 5 to rotate. The rotation of the output shaft 5 is transmitted to the pinion 7 through the clutch 6. At this time, since the pinion 7 is already in mesh with the ring gear 13, the rotational force of the pinion 7 is transmitted to the ring gear 17 to crank the engine.

The electromagnetic switch 1 described above provides the following advantages. The solenoid SL1 includes the first example of the surge suppression device 24 connected in parallel to the SL1 coil 9 between the power supply side and the ground side of the SL1 coil 9. The first example of the surge suppression device 24 is configured to absorb part of the energy emitted from the SL1 coil 9 when the SL1 relay 12 is turned from on to off, so that the other part of the energy is applied to the SL1 relay 12 to cause an appropriate arc current to flow between the contacts of the SL1 relay 12. Specifically, when the SL1 relay 12 is turned from on to off, since a counter-electromotive force occurs across the SL1 coil 9 with the ground side of the SL1 9 coil being positive and the power supply side of the SL1 9 coil being negative, the diode 25 is forward-biased, and the Zener diode 26 is reverse-biased.

Figure 4:
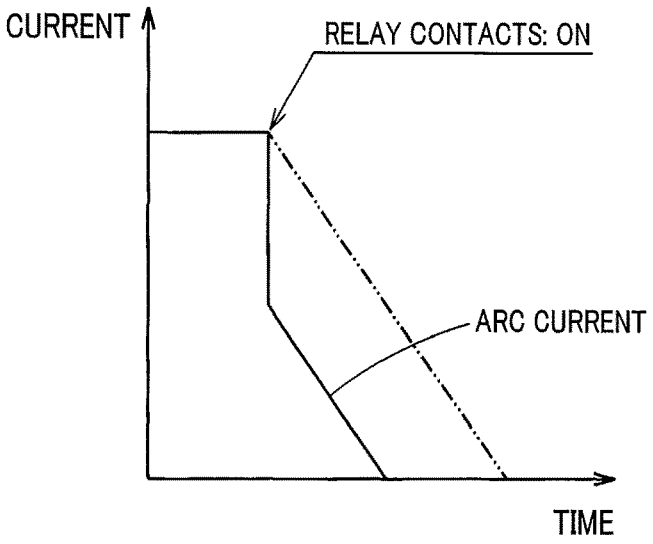
FIG. 4 is a graph explaining effects of the surge suppression device according to the first example.

While the voltage applied to the cathode of the Zener diode 26 is higher than the Zener voltage, a current flows through the Zener diode 26 in the direction from the cathode to the anode. That is, since a current circulates through the SL1 coil 9 and the surge suppression device 24 which are parallel-connected between the SL1 terminal 11 and the metal component, part of the energy emitted from the SL1 coil 9 is consumed as Joule heat. Since no arc current flows between the contacts of the SL1 relay 12 while the current circulates through the SL1 coil 9 and the surge suppression device 24 as shown in FIG. 4, it is possible to suppress wear of the contacts to increase the life of the contacts. Incidentally, the two-point chain line in FIG. 4 shows the transition of an arc current in a case where the surge suppression device 24 is not provided, that is, a case where all the energy emitted from the SL1 coil 9 is applied to the SL1 relay 12.

Thereafter, when the voltage applied to the cathode of the Zener diode 26 falls below the Zener voltage, since no current flows through the Zener diode 26, the remaining part of the energy emitted from the SL1 coil 9 is applied to the SL1 relay 12. As a result, as shown in FIG. 4, since adequate arc current flows between the contacts of the SL1 relay 12, the contact surfaces can be cleaned. Here, the "adequate current" means a current which is not so large as to promote wear of the contacts of the SL1 relay, but is large enough to clean the contact surfaces, and can be adjusted in accordance with the Zener voltage of the Zener diode 26. In the above, the advantageous effects due to the provision of the surge suppression device 24 are explained for the solenoid SL1. It is needless to say that the same advantageous effects can be provided for the solenoid SL2.

Next, other examples of the surge suppression device 24 are explained.

Second Example

Figure 5:
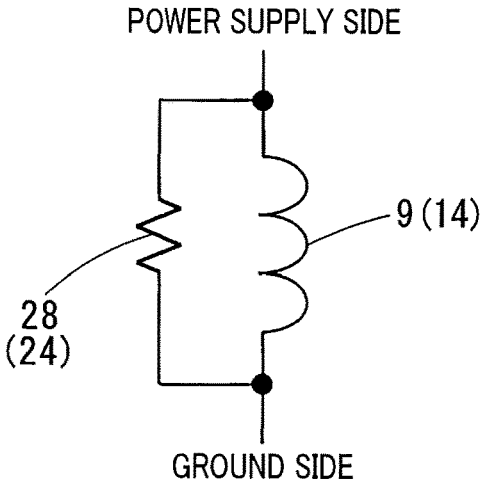
FIG. 5 is a diagram showing the structure of a surge suppression device according to a second example included in the electromagnetic switch.

The surge suppression device 24 according to a second example is constituted of a resistor 28 connected in parallel to the SL1 coil 9 or the SL2 coil SL14 between the power supply side and the ground side as shown in FIG. 5. When the SL1 relay 12 or the SL2 relay 17 is turned from on to off, a current due to a counter-electromotive force generated across the SL1 coil 9 or the SL2 coil 14 circulates through the resistor 28 and the SL1 coil 9 or the SL2 coil 14. This circulation current can be adjusted by adjusting the resistance of the resistor 28.

Figure 6:
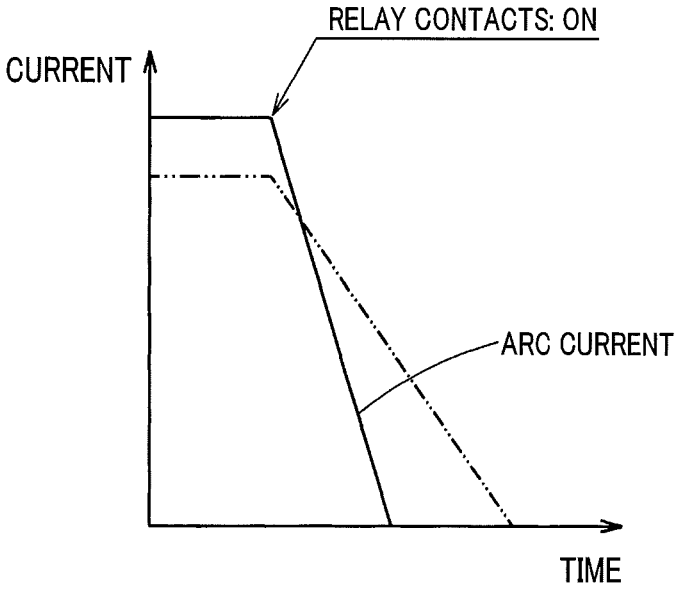
FIG. 6 is a graph explaining effects of the surge suppression device according to the second example.

Accordingly, part of the energy emitted from the SL1 coil 9 or the SL2 coil 14 is consumed by the resistor 28, and the remaining part of the energy is applied to the SL1 relay 12 or the SL2 relay 17. As a result, as shown in FIG. 6, adequate current flows between the contacts of the SL1 relay 12 or the SL2 relay 17, the contact surfaces can be cleaned. Incidentally, in this example shown in FIG. 5, a dark current flows through the resistor 28 while the SL1 relay 12 or the SL2 relay 17 is on. Accordingly, the current which flows through the SL1 relay 12 or the SL2 relay 17 when the contacts are closed in this example is larger by the dark current than that in the first example as shown in FIG. 6.

Third Example

Figure 7:
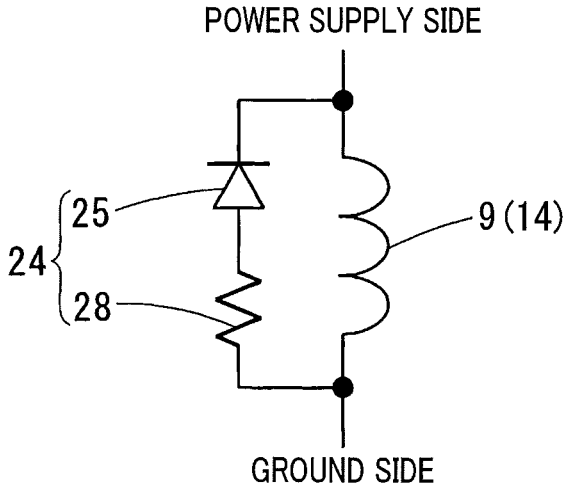
FIG. 7 is a diagram showing the structure of a surge suppression device according to a third example included in the electromagnetic switch.
Figure 8:
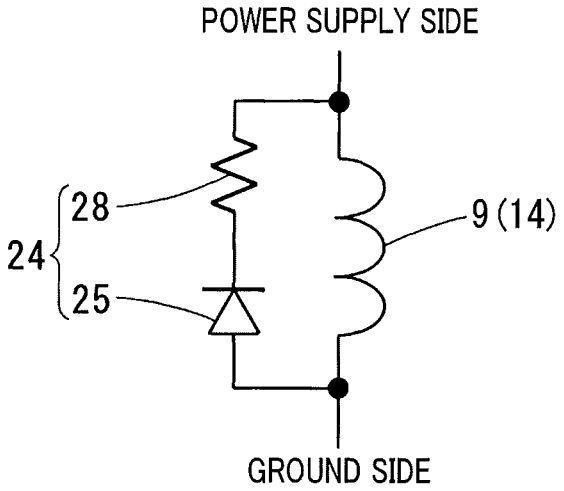
FIG. 8 is a diagram showing the structure of a modification of the surge suppression device according to the third example.

The surge suppression device 24 according to a third example is constituted of a series connection of a resistor 28 and a diode 25. As shown in FIG. 7, the anode of the diode 25 is connected to one end of the resistor 28, the cathode of the diode 25 is connected to the power supply side of the SL1 coil 9 or the SL2 coil 14, and the other end of the resistor 28 is connected to the ground side of the SL1 coil 9 or the SL2 coil 14. FIG. 8 shows a modification of the surge suppression device 24 according to the third embodiment. In this modification, the diode 25 is disposed on the ground side and the resistor 28 is disposed on the power supply side in contrast to the example shown in FIG. 7. Specifically, the cathode of the diode 25 is connected to one end of the resistor 28, the anode of the diode 25 is connected to the ground side of the SL1 coil 9 or the SL2 coil 14, and the other end of the resistor 28 is connected the power supply side of the SL1 coil 9 or the SL2 coil 14. Like in the second example, in the third example and the modification of the third example, part of the energy emitted from the SL1 coil 9 or the SL2 coil 14 when the SL1 relay 12 or the SL2 relay 17 is turned from on to off is consumed by the resistor 28, and the remaining part of the energy is applied to the SL1 relay 12 or the SL2 relay 17.

Figure 9:
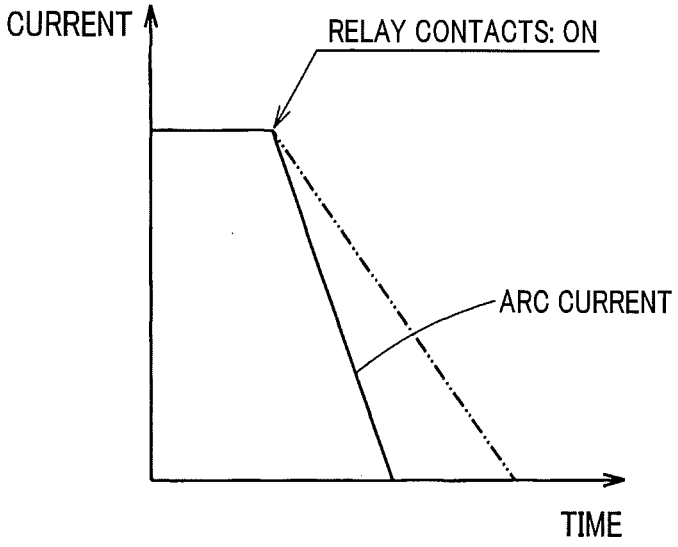
FIG. 9 is a graph explaining effects of the surge suppression device according to the third example.

As a result, as shown in FIG. 9, since adequate current flows between the contacts of the SL1 relay 12 or the SL2 relay 17, the contact surfaces can be cleaned. Incidentally, in the examples shown in FIGS. 7 and 8, since the diode 25 is reverse-biased while the SL1 relay 12 or the SL2 relay 17 is on, no dark current flows through the resistor 28.

Fourth Example

Figure 10:
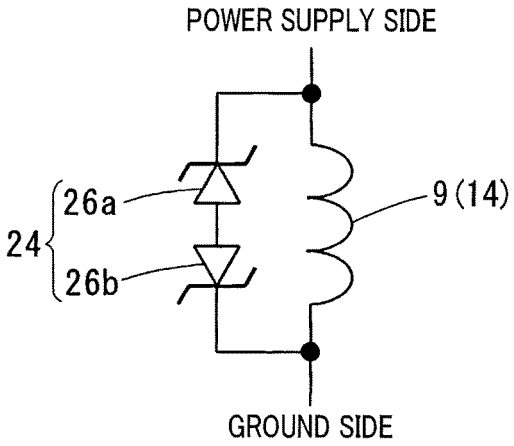
FIG. 10 is a diagram showing the structure of a surge suppression device according to a fourth example included in the electromagnetic switch.

The surge suppression device 24 according to a fourth example is constituted of a first Zener diode 26*a* and a second Zener diode 26*b* connected in series as shown in FIG. 10. Specifically, the anodes of the first and second Zener diodes 26*a* and 26*b* are connected to each other, the cathode of the first Zener diode 26*a* is connected to the power supply side of the SL1 coil 9 or the SL2 coil 14, and the cathode of the second Zener diode 26*b* is connected to the ground side of the SL1 coil 9 or the SL2 coil 14.

Figure 11:
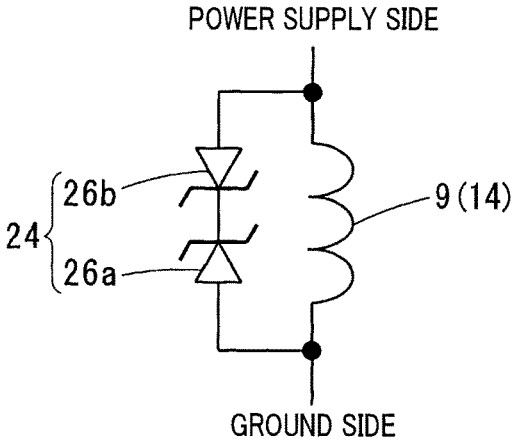
FIG. 11 is a diagram showing the structure of a modification of the surge suppression device according to the fourth example.

FIG. 11 shows a modification of the surge suppression device 24 according to the fourth embodiment. In this modification, the first Zener diode 26*a* is disposed on the ground side, and the second Zener diode 26*b* is disposed on the power supply side in contrast to the example shown in FIG. 10. Specifically, the cathodes of the first and second Zener diodes 26*a* and 26*b* are connected to each other, the anode of the first Zener diode 26*a* is connected to the ground side of the SL1 coil 9 or the SL2 coil 14, and the anode of the second Zener diode 26*b* is connected to the power supply side of the SL1 coil 9 or the SL2 coil 14. The structure of surge suppression device 24 according to the fourth example is the same as the structure of that according to the first example in which the diode 25 is replace by the Zener diode 26. The fourth example provides the advantage similar to that provided by the first example.

Fifth Example

Figure 12:
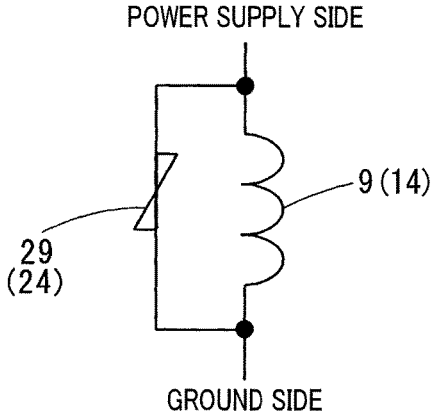
FIG. 12 is a diagram showing the structure of a surge suppression device according to a fifth example included in the electromagnetic switch.

The surge suppression device 24 according to a fifth example is constituted of a varistor 29 parallel-connected to the SL1 coil 9 or the SL2 coil 14 between the power supply side and the ground side as shown in FIG. 12. The varistor 29 is equivalent to two Zener diodes 26 which are connected oppositely with each other and a capacitor parallel-connected thereto. Accordingly, the fifth example provides the advantage similar to that provided by the first or fourth example.

Sixth Example

Figure 13:
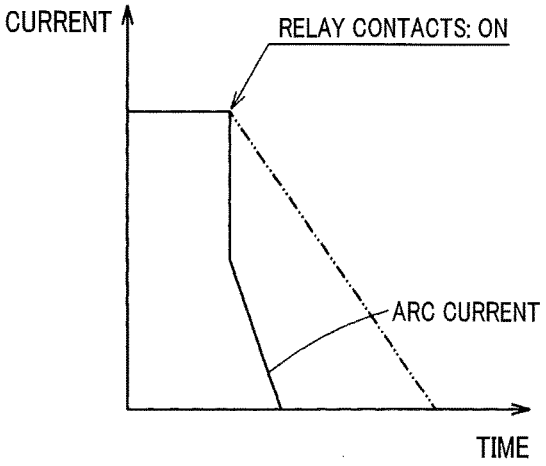
FIG. 13 is a graph explaining effects of a surge suppression device according to a sixth example included in the electromagnetic switch.

The structure of the surge suppression device 24 according to a sixth example is that of each of the first, fourth and fifth example, each of which is additionally provided with the resistor 28 series-connected thereto. According to the sixth example, the arc current flowing between the contacts of the SL1 relay 12 or the SL2 relay 17 can be adjusted in accordance with the Zener voltage of the Zener diode 26 explained in the first example or the resistance of the resistor 28 (see FIG. 13). Accordingly, the sixth example provides the advantage similar to that provided by the first, fourth or fifth example.

It is a matter of course that various modifications can be made to the above described embodiment as described below. The electromagnetic switch 1 according to the above embodiment is a tandem solenoid type switch including two solenoids. However, the electromagnetic switch 1 may be a switch including a single solenoid which is used for both pushing out the pinion 7 and opening/closing the main contact. The solenoid in this case is a single-coil type solenoid in which the same coil doubles as an attraction coil for attracting a plunger and a holding coil for holding the plunger.

The above explained preferred embodiments are exemplary of the invention of the present application which is described solely by the claims appended below. It should be understood that modifications of the preferred embodiments may be made as would occur to one of skill in the art.

What is claimed is:

1. An electromagnetic switch for a starter, comprising:

a coil that includes a first lead wire connected to a power supply side and a second lead wire connected to a ground side, the coil being supplied with an energization current through the first and second lead wires to form an electromagnet while a starter relay is on, the starter relay being different from the electromagnetic switch; and a surge suppression device that absorbs part of energy emitted from the coil when the starter relay is turned from on to off so that a remaining part of the energy is applied to the starter relay to cause an arc current to flow between contacts of the starter relay, wherein the surge suppression device includes a diode and a Zener diode which are coupled such that (i) anodes of the diode and the Zener diode are connected to each other, a cathode of the diode is connected to the power supply side of the coil and a cathode of the Zener diode is connected to the ground side of the coil, or such that (ii) the cathodes of the diode and the Zener diode are connected to each other, the anode of the Zener diode is connected to the power supply side of the coil and the anode of the diode is connected to the ground side of the coil, and the Zener diode has a predetermined Zener voltage selected to determine an amount of the arc current to flow between the contacts of the starter relay.

2. The electromagnetic switch according to claim 1, wherein the surge suppression device includes a resistor connected in series with the diode and the Zener diode.

3. The electromagnetic switch according to claim 1, wherein the diode is a second Zener diode.

4. The electromagnetic switch according to claim 3, wherein the surge suppression device includes a resistor connected in series with the Zener diode and the second Zener diode.

5. The electromagnetic switch according to claim 1, wherein the predetermined Zener voltage has a value selected so that an amount of the arc current to flow between the contacts of the starter relay cleans contact surfaces of the contacts of the starter relay without promoting wear of the contacts.

* * * * *